US010260490B2

(12) United States Patent
Fochtman et al.

(10) Patent No.: US 10,260,490 B2
(45) Date of Patent: Apr. 16, 2019

(54) METHODS AND APPARATUS FOR COOLING A SOLENOID COIL OF A SOLENOID PUMP

(71) Applicant: Synerject LLC, Newport News, VA (US)

(72) Inventors: James Fochtman, Williamsburg, VA (US); John Walters, Williamsburg, VA (US)

(73) Assignee: Synerject LLC, Newport News, VA (US)

( * ) Notice: Subject to any disclaimer, the term of this patent is extended or adjusted under 35 U.S.C. 154(b) by 600 days.

(21) Appl. No.: 14/724,148

(22) Filed: Jun. 9, 2015

(65) Prior Publication Data

US 2016/0108909 A1 Apr. 21, 2016

Related U.S. Application Data

(60) Provisional application No. 62/009,597, filed on Jun. 9, 2014.

(51) Int. Cl.
*F04B 35/04* (2006.01)
*F04B 39/06* (2006.01)
(Continued)

(52) U.S. Cl.
CPC ..... *F04B 17/046* (2013.01); *F02M 37/10* (2013.01); *F04B 17/04* (2013.01); *F04B 17/042* (2013.01);
(Continued)

(58) Field of Classification Search
CPC ..... F04B 17/04; F04B 17/042; F04B 17/044; F04B 35/045; F04B 39/06; F04B 39/006; F04B 53/08
(Continued)

(56) References Cited

U.S. PATENT DOCUMENTS 1,625,789 A 4/1927 Braselton et al.
1,661,359 A 3/1928 Chryst et al.
(Continued)

FOREIGN PATENT DOCUMENTS

CN 2916171 Y 6/2007
CN 201258848 Y 6/2009
(Continued)

OTHER PUBLICATIONS

PCT/US15/33996 International Search Report and the Written Opinion of the International Searching Authority dated Jun. 3, 2015.
(Continued)

*Primary Examiner* — Peter J Bertheaud

(57) ABSTRACT

In some embodiments, a solenoid-actuated pump includes a first pumping chamber and a second pumping chamber, where the first pumping chamber delivers fluid from the pump to portions of a vehicle to facilitate the operation of the vehicle. The second (or "parasitic") pumping chamber implements a forced convection cooling method, which utilizes parasitic pumping loss to produce a flow within and/or around the solenoid coil to cool the coil and/or maintain the temperature of the coil during operation. In this manner, the second pumping chamber produces a flow that reduces thermally-related increases in electrical resistance of the solenoid coil of the solenoid-actuated pump.

20 Claims, 11 Drawing Sheets

(51) Int. Cl.

| | |
|---|---|
| ***F04B 17/04*** | (2006.01) |
| ***F02M 37/10*** | (2006.01) |
| ***F04B 23/06*** | (2006.01) |
| ***F04B 53/08*** | (2006.01) |

(52) U.S. Cl.
CPC ..... *F04B 23/06* (2013.01); *F04B 35/045* (2013.01); *F04B 39/066* (2013.01); *F04B 53/08* (2013.01)

(58) Field of Classification Search
USPC ..... 417/367, 368, 422
See application file for complete search history.

(56) References Cited

U.S. PATENT DOCUMENTS 2,091,499 A 8/1937 Brown
2,222,823 A 11/1940 Parenti
2,369,282 A 2/1945 Curtis et al.
2,984,187 A 5/1961 Prasse et al.
3,181,194 A 5/1965 Daykin et al.
3,491,029 A 1/1970 Kasperl et al.
3,507,263 A 4/1970 Long
3,515,167 A 6/1970 Svenson
4,203,395 A 5/1980 Cromas et al.
4,252,505 A 2/1981 Toyoda
4,394,148 A 7/1983 Ryan
4,422,420 A 12/1983 Cromas et al.
4,543,914 A 10/1985 Harris
4,860,714 A 8/1989 Bucci
4,928,656 A 5/1990 Ausiello
4,949,215 A 8/1990 Studtmann et al.
5,070,849 A 12/1991 Rich et al.
5,080,077 A 1/1992 Sawert et al.
5,103,793 A 4/1992 Riese et al.
5,161,083 A 11/1992 Mohler et al.
5,289,810 A 3/1994 Bauer et al.
5,341,842 A 8/1994 Chih et al.
5,361,742 A 11/1994 Briggs et al.
5,389,245 A 2/1995 Jaeger et al.
5,415,146 A 5/1995 Tuckey
5,452,701 A 9/1995 Tuckey
5,458,767 A 10/1995 Stone
5,469,829 A 11/1995 Kleppner et al.
5,520,156 A 5/1996 Brunnhofer
5,579,739 A 12/1996 Tuckey et al.
5,590,631 A 1/1997 Tuckey
5,647,330 A 7/1997 Sawert et al.
5,649,514 A 7/1997 Okada et al.
5,655,504 A 8/1997 Iwai
5,715,798 A 2/1998 Bacon et al.
5,718,208 A 2/1998 Brautigan et al.
5,727,529 A 3/1998 Tuckey
5,743,239 A 4/1998 Iwase
5,769,061 A 6/1998 Nagata et al.
5,791,317 A 8/1998 Eck
5,960,775 A 10/1999 Tuckey
6,102,679 A 8/2000 Brown
6,106,244 A 8/2000 Nakatsukasa et al.
6,113,781 A 9/2000 Popoff et al.
6,119,655 A 9/2000 Heinitz et al.
6,123,521 A 9/2000 Mori et al.
6,142,126 A 11/2000 Kanamaru
6,149,399 A 11/2000 Bowser et al.
6,155,793 A 12/2000 Tuckey et al.
6,209,309 B1 4/2001 McArthur
6,213,143 B1 4/2001 Schwegler et al.
6,213,726 B1 4/2001 Tuckey
6,216,671 B1 4/2001 Sawert et al.
6,220,454 B1 4/2001 Chilton
6,240,902 B1 6/2001 Tanaka et al.
6,241,883 B1 6/2001 Noda
6,253,735 B1 7/2001 Miyajima
6,260,543 B1 7/2001 Chih
6,273,056 B1 8/2001 Shirakawa et al.
6,293,770 B1 9/2001 Matsumoto et al.
6,295,662 B1 10/2001 Idland et al.
6,296,012 B1 10/2001 Kilgore et al.
6,311,725 B1 11/2001 Hamada et al.
6,343,589 B1 2/2002 Talaski et al.
6,364,630 B1 4/2002 Craft et al.
6,422,836 B1 7/2002 Krueger
6,424,924 B1 7/2002 Wagner et al.
6,439,205 B2 8/2002 Ushigome
6,457,458 B1 10/2002 Frank et al.
6,488,476 B2 12/2002 Eck
6,520,163 B2 2/2003 Yoshioka et al.
6,615,780 B1 9/2003 Lin et al.
6,659,085 B2 12/2003 Kojima
6,679,227 B2 1/2004 Sawert et al.
6,719,539 B1 4/2004 Yoshioka
6,725,837 B2 4/2004 Hiraku et al.
6,729,309 B2 5/2004 Schueler
6,733,249 B2 5/2004 Maier et al.
6,773,241 B2 8/2004 Suzuki et al.
6,786,709 B1 9/2004 Klahm et al.
6,805,331 B2 10/2004 Lin et al.
6,925,990 B1 8/2005 Konopacki
6,928,989 B2 8/2005 Powell
6,976,473 B2 12/2005 Boos et al.
6,981,490 B2 1/2006 Nagata et al.
7,069,912 B2 7/2006 Yoshioka
7,111,460 B2 9/2006 Jensen et al.
7,117,854 B2 10/2006 Schmitt
7,146,968 B2 12/2006 Koito et al.
7,209,020 B2 4/2007 Telep
7,228,844 B2 6/2007 Ricco et al.
7,237,538 B2 7/2007 Perruchot et al.
7,246,636 B2 7/2007 Dudra et al.
7,296,980 B2 11/2007 Olivieri et al.
7,412,968 B2 8/2008 Takayanagi et al.
7,444,988 B2 11/2008 Ricco et al.
7,481,337 B2 1/2009 Luharuka et al.
7,552,720 B2 6/2009 Borg et al.
7,617,814 B2 11/2009 Leppert
7,677,225 B2 3/2010 Radue et al.
7,747,377 B2 6/2010 Nakata et al.
7,753,657 B2 7/2010 Strauss et al.
7,775,235 B2 8/2010 Leppert et al.
7,784,447 B2 8/2010 Ricco et al.
7,845,343 B2 12/2010 Imai
8,018,695 B2 9/2011 Serizawa et al.
8,079,479 B2 12/2011 Leppert
8,113,796 B2 2/2012 Marz et al.
8,210,139 B2 7/2012 Meisel
8,360,740 B2 1/2013 Leppert
8,427,263 B2 4/2013 Leppert et al.
8,550,794 B2 * 10/2013 Du ..... F04B 3/00 417/418
2002/0152996 A1 10/2002 Gabauer et al.
2003/0024509 A1 2/2003 Matusek et al.
2003/0127075 A1 7/2003 Braun et al.
2003/0131828 A1 7/2003 Crary
2003/0000502 A1 9/2003 Jones et al.
2004/0000344 A1 1/2004 Okabe et al.
2004/0037713 A1 2/2004 Schelhas et al.
2004/0076528 A1 4/2004 Kolb et al.
2004/0173187 A1 10/2004 Kanamaru et al.
2005/0145812 A1 7/2005 Kumar
2005/0178853 A1 8/2005 Doble et al.
2006/0024176 A1 2/2006 Ikeya
2006/0070941 A1 4/2006 Cline et al.
2006/0096582 A1 5/2006 Powell et al.
2006/0021603 A1 7/2006 Nagata
2006/0171816 A1 8/2006 Strauss et al.
2006/0130815 A1 10/2006 Gaffield et al.
2006/0231079 A1 10/2006 Paluszewski
2007/0074770 A1 4/2007 Witherspoon et al.
2007/0113830 A1 5/2007 Koito et al.
2007/0128049 A1 6/2007 Sanchez et al.
2007/0204835 A1 9/2007 Xi et al.
2007/0272217 A1 11/2007 Kubota et al.
2010/0163327 A1 7/2010 Bernier et al.
2010/0269789 A1 10/2010 Jensen et al.

(56) References Cited

U.S. PATENT DOCUMENTS

| | | | |
|---|---|---|---|
| 2011/0097228 | A1 | 4/2011 | Tokuo et al. |
| 2011/0098906 | A1 | 4/2011 | Barrows et al. |
| 2011/0192381 | A1 | 8/2011 | Maruyama et al. |
| 2011/0194946 | A1 | 8/2011 | Bedard et al. |
| 2011/0217186 | A1 | 9/2011 | Yoshizawa et al. |
| 2012/0000445 | A1 | 1/2012 | Borg et al. |
| 2012/0080367 | A1 | 10/2012 | Leppert |
| 2013/0061939 | A1 | 3/2013 | Leppert et al. |

FOREIGN PATENT DOCUMENTS

| | | | |
|---|---|---|---|
| CN | 102011720 | A | 4/2011 |
| DE | 10028458 | A1 | 12/2001 |
| DE | 10328206 | A1 | 1/2005 |
| DE | 202006010856 | U1 | 3/2008 |
| EP | 1508688 | A1 | 2/2005 |
| GB | 2328659 | A | 3/1999 |
| JP | 2005256741 | A | 9/2005 |
| WO | 2008049900 | A1 | 5/2008 |

OTHER PUBLICATIONS

Twain Office Action dated Sep. 14, 2016 for counterpart Twain Patent Application No. 104118610.
Chinese Office Action dated Jun. 8, 2018 for counterpart Chinese Patent Application No. 201580030656.0.
Chinese Office Action dated Nov. 26, 2018 for corresponding Chinese Patent Application No. 201580030656.0.

* cited by examiner

METHODS AND APPARATUS FOR COOLING A SOLENOID COIL OF A SOLENOID PUMP

CROSS-REFERENCE TO RELATED APPLICATIONS

This application claim priority to and benefit of U.S. Provisional Application Ser. No. 62/009,597, entitled "Methods and Apparatus for Cooling a Solenoid Coil for Solenoid Pump," filed Jun. 9, 2014, the entirety of which is incorporated herein by reference.

BACKGROUND

The embodiments described herein relate to methods and apparatus for cooling solenoids used in solenoid pumps, and more particularly, to methods and apparatus including a secondary pumping chamber to cool the solenoid coil of a solenoid pump.

Known solenoid pump assemblies are used in a variety of different applications. For example, known solenoid pump assemblies are used in a variety of vehicle applications, such as, for example, to transfer oil, fuel and/or other fluids to facilitate the operation of the vehicle. Typically, solenoid pumps or pump assemblies can be configured to receive an electrical current to cause an armature to move, thus actuating a pumping mechanism to enable transfer of fluid. In most known systems, the armature can be moved along a fixed stroke length, wherein the distance between two end-stops is fixed. Similarly stated, in normal operation, when the solenoid coil is actuated, the armature moves a fixed distance or "stroke." The volume of fluid pumped is proportional to the stroke length and the frequency of operation.

When a solenoid pump is required to pump at high frequency (e.g., to increase the flow rate), the electromagnetic force must be generated quickly. To facilitate rapid generation of electromagnetic force, without expensive/high voltage drive electronics, it is desirable that the solenoid coil have relatively low electrical resistance. The low coil resistance, however, can lead to resistive heating, which, in turn increases the resistance of the solenoid coil, resulting in an increased voltage requirement. Thus, to maintain the desired operating voltage, the inherent electrical resistance of the solenoid coil needs to be maintained at a low value and/or additional wire turns need to be added to the solenoid coil design. Adding turns to the solenoid coil, however, increases the coil inductance, which can undesirably slow the rise of the electromagnetic force in the solenoid coil. Additionally, reducing the initial electrical resistance of the solenoid coil (i.e., to accommodate expected resistance increase) can lead to additional resistive heating during use that can exaggerate the resistance change (due to the dissipation of significant power during high frequency operation).

The increased coil resistance caused by the resistive heating can result in lower peak current during operation. To overcome the diminished performance due to the lower peak current, the pulse width and/or frequency of operation can be increased. This, however, further increases the power dissipation of the solenoid coil, and exaggerates the heating, and eventually leads to lower force values and a minimum operating voltage near or above the designs nominal operating voltage.

Accordingly, a need exists for system and methods to reduce thermally-related increases in solenoid coil electrical resistance during operation to allow the operation of the pump at high frequencies.

SUMMARY

Apparatus and methods for cooling a solenoid coil during operation of a fluid transfer assembly are described herein. In some embodiments, an apparatus includes a pump assembly and a pumping element. The pump assembly defines a first pumping chamber and a second pumping chamber. The first pumping chamber is fluidically isolated from the second pumping chamber. The first pumping chamber is fluidically coupled to a first fluid path and the second fluid chamber is fluidically coupled to a second fluid path. The pumping element is configured to move within the pump assembly between a first configuration and a second configuration. When the pumping element moves from the first configuration to the second configuration, the pumping element moves a first fluid into the first pumping chamber and a second fluid into the second pumping chamber. When the pumping element moves from the second configuration to the first configuration, the pumping element expels the first fluid from the first pumping chamber and the second fluid from the second pumping chamber.

DETAILED DESCRIPTION

Figure 1C:
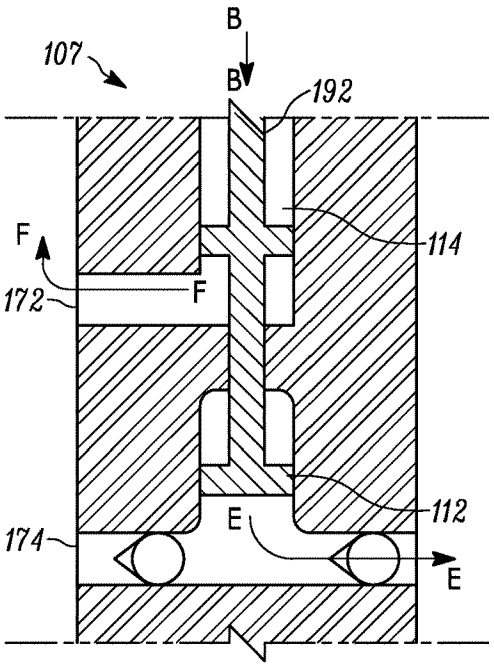
FIGS. 1A-1C are cross-sectional schematic illustrations of a fluid transfer system, according to an embodiment.

Methods and apparatus for cooling a solenoid coil during operation of a fluid transfer assembly are described herein. In some embodiments, an apparatus includes a pump assembly and a pumping element. The pump assembly defines a first pumping chamber and a second pumping chamber, where the second pumping chamber is fluidically isolated from the first pumping chamber. The first pumping chamber is fluidically coupled to a first fluid path and the second fluid chamber is fluidically coupled to a second fluid path. The apparatus also includes a pumping element configured to move within the pump assembly between a first configuration and a second configuration. When the pumping element moves from the first configuration to the second configuration, the pumping element moves a first fluid into the first pumping chamber and a second fluid into the second pumping chamber. When the pumping element moves from the second configuration to the first configuration, the pumping element expels the first fluid from the first pumping chamber and the second fluid from the second pumping chamber.

In some embodiments, an apparatus includes a pump assembly, a solenoid assembly, and a housing. The pump assembly includes a pumping element and defines a first pumping chamber and a second pumping chamber. The second pumping chamber is fluidically isolated from the first pumping chamber. The first pumping chamber is fluidically coupled to a first fluid path and the second pumping chamber is fluidically coupled to a second fluid path. The solenoid assembly that includes a solenoid coil and at least one electrical lead. When the solenoid coil is energized, the solenoid assembly is configured to move the pumping element within the first pumping chamber and the second pumping chamber. The solenoid assembly is contained in the housing, which is configured to be disposed within a reservoir containing a fluid. The housing and/or the solenoid assembly, or a combination thereof, define at least a portion of the second fluid path. The housing defines an opening in fluid communication with the second fluid path that is aligned with the electrical lead of the solenoid assembly. Additionally, the pumping element is configured to convey a portion of the fluid within the second fluid path via the opening when the solenoid assembly is energized and de-energized.

In some embodiments, a method includes first receiving a signal configured to energize a solenoid coil. Energizing the solenoid coil causes a pumping element to move in a first direction within a pump assembly. The pump assembly defines a first pumping chamber and a second pumping chamber that is fluidically isolated from the first pumping chamber. The first pumping chamber is fluidically coupled to a first fluid path and the second pumping chamber is fluidically coupled to a second fluid path. Then, the signal is removed from the solenoid to cause the pumping element to move in a second direction within the pump assembly. The pumping element conveys a first fluid from the first pumping chamber into the first fluid path and a second fluid from the second pumping chamber into the second fluid path in response to the receiving and removing.

As used in this specification, a module can be, for example, any assembly and/or set of operatively-coupled electrical components associated with performing a specific function(s), and can include, for example, a memory, a processor, electrical traces, optical connectors, software (that is stored in memory and/or executing in hardware) and/or the like.

As used in this specification, the singular forms "a," "an" and "the" include plural referents unless the context clearly dictates otherwise. Thus, for example, the term "a coil" is intended to mean a single coil or multiple coils, "a processor" is intended to mean a single processor or multiple processors; and "memory" is intended to mean one or more memories, or a combination thereof.

As used in this specification, unless otherwise stated, the term "solenoid coil" can be used interchangeably with a coil. As used in this specification, a solenoid coil or a coil can refer specifically to a long, thin loop of wire, typically wound into a tightly packed arrangement and wrapped around a metallic core, which produces a magnetic field in a volume of space when an electric current is passed through the wire.

Figure 1B:
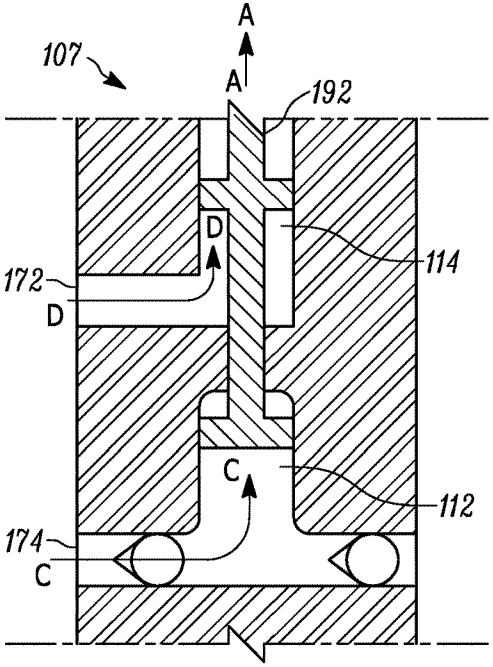
Figure 1A:
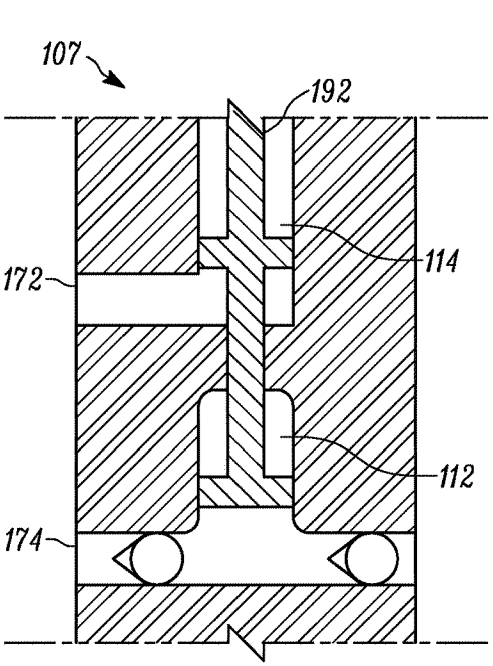

FIGS. 1A-1C are cross-sectional views of a fluid transfer system, according to an embodiment, in a first configuration (FIGS. 1A and 1C) and a second configuration (FIG. 1B). The fluid transfer system 100 includes a pump assembly 107 and a pumping element 192. The pump assembly 107 defines a first pumping chamber 112 and a second pumping chamber 114 that is fluidically isolated from the first pumping chamber 112. The first pumping chamber 112 is fluidically coupled to a first fluid path 174 and the second pumping chamber 114 is fluidically coupled to a second fluid path 172. The first pumping chamber 112 can be fluidically coupled to the first fluid path 174, and the second pumping chamber 114 can be fluidically coupled to the second fluid path 172 by any suitable mechanism, such as, for example, via passageway formed in a monolithic housing, a fitting, a hose connection or the like. Although the pump assembly 107 is shown as being a monolithic component that defines the first pumping chamber 112 and the second pumping chamber 114, in other embodiments, the pump assembly 107 can include multiple components or modules that define the first pumping chamber 112 and the second pumping chamber 114, and that are constructed separately and later joined together.

The pumping element 192 is at least partially disposed in the pump assembly 107, and is configured to move within the pump assembly 107 between a first configuration (FIG. 1A) and a second configuration (FIG. 1B), as indicated by the arrows AA and BB. When the pumping element 192 moves from the first configuration to the second configuration (as shown by the arrow AA in FIG. 1B), a first fluid is moved into the first pumping chamber 112 (as shown by arrow CC in FIG. 1B), and a second fluid is moved into the second pumping chamber 114 (as shown by arrow DD in FIG. 1B). This can be referred to as the intake stroke of the system 100. When the pumping element 192 moves from the second configuration (FIG. 1B) back to the first configuration (FIG. 1C), as indicated by the arrow BB, the first fluid is expelled from the first pumping chamber 112 (as shown by arrow EE in FIG. 1C) and the second fluid is expelled from the second pumping chamber 114 (as shown by arrow FF in FIG. 1C). This can be referred to as the pumping stroke of the system 100.

In some embodiments, the first pumping chamber 112 can be referred to as the primary pumping chamber, and can convey the first fluid to a device (e.g., an engine, compressor or other fluid machinery, not shown) via the first fluid path 174 to facilitate operation of the device. The second pumping chamber 114 can be referred to as the secondary (or parasitic) pumping chamber and can convey the second fluid within the system 100 via the second fluid path 172 to facilitate operation of the system 100. For example, in some embodiments, the second fluid path 172 can be in communication and/or can define a portion of a cooling circuit through which the second fluid can flow to cool a portion of the system (e.g., a solenoid, an actuator, or the like, not shown).

Although the first pumping chamber 112 is shown as having an inlet port and an outlet port, in other embodiments, the first pumping chamber 112 can include any port arrangement. For example, in some embodiments, the first pumping chamber 112 can include and/or be in fluid communication with only one port that is used for both fluid entry and expulsion (i.e., to produce a reciprocal flow of the first fluid). In other embodiments, the first pumping chamber 112 can include and/or be in fluid communication with multiple ports which are each designated as being for fluid entry, expulsion, or both. Although the second pumping chamber 114 is shown to have only one port for both fluid entry and expulsion (i.e., to produce a reciprocal flow of the second fluid), in other embodiments, the second pumping chamber 114 can include any port arrangement. For example, in some embodiments, the second pumping chamber 114 can include and/or be in fluid communication with a second port so that one port functions as an inlet port and the other port functions as an outlet port. The second pumping chamber 114 can also include multiple ports that function as fluid inlet ports, fluid outlet ports, or both. Additionally, the first pumping chamber 112 and the second pumping chamber 114 can optionally include any valve arrangement to control the flow of fluid.

Figure 2:
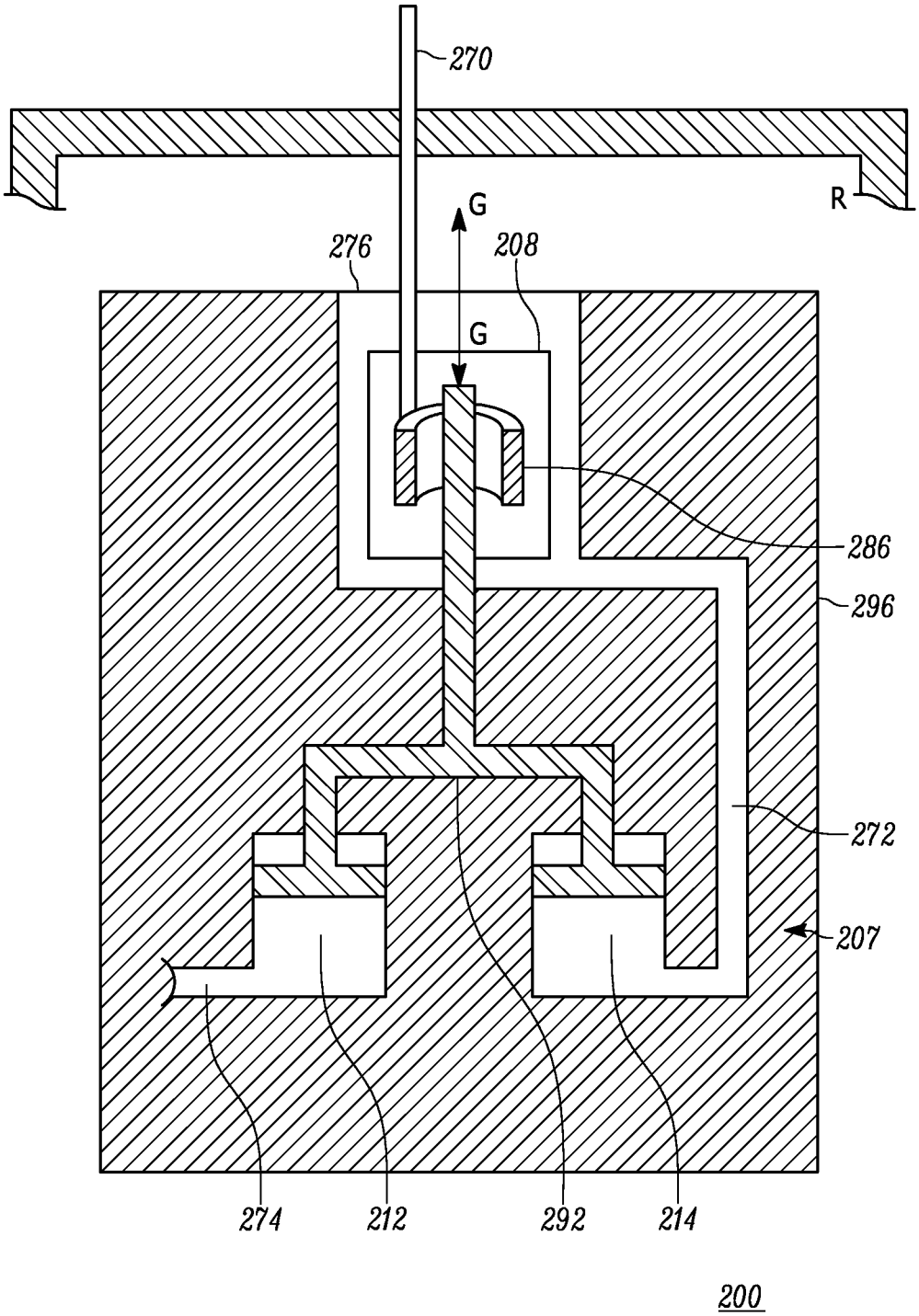
FIG. 2 is a cross-sectional schematic illustration of a fluid transfer system, according to an embodiment.

Although the fluid transfer system 100 is shown as defining two pumping chambers in a linear arrangement within the pump assembly 107, in other embodiments, a fluid transfer system can define any number of pumping chambers in any suitable arrangement. For example, FIG. 2 is a schematic cross-sectional illustration of a fluid transfer system 200, according to an embodiment. The fluid transfer system 200 includes a pump assembly 207, a solenoid coil 286 and a housing 296. The pump assembly 207 defines a first pumping chamber 212 and a second pumping chamber 214 that is fluidically isolated from the first pumping chamber 212. The first pumping chamber 212 is fluidically coupled to a first fluid path 274 and the second pumping chamber 214 is fluidically coupled to a second fluid path 272.

The pump assembly 207 includes a pumping element 292 that moves between a first configuration and a second configuration, as indicated by the arrow GG, when the solenoid coil 286 is energized and de-energized. When the pumping element 292 moves, a first portion of the pumping element 292 moves within the first pumping chamber 212, and a second portion of the pumping element 292 moves within the second pumping chamber 214. In this manner, flows can be produced within the first fluid path 274 and the second fluid path 272, as described below.

The solenoid assembly 208 includes a solenoid coil 286 and at least one electrical lead 270. The solenoid assembly 208 is contained within the housing 296, which is configured to be disposed within a reservoir R containing a fluid. In this manner, the solenoid assembly 208 and the housing 296 can form a part of an in-tank fluid transfer system (e.g., an in-tank oil pump assembly, fuel pump assembly, or the like). Although the entire fluid transfer assembly 200 is shown as being disposed within the reservoir R, in other embodiments, portions of the fluid transfer assembly 200 can be disposed within the reservoir R while other portions can be disposed outside of the reservoir R.

The housing 296 defines at least a portion of the first fluid path 274. The housing 296 and/or the solenoid assembly 208, or a combination thereof, define both a portion of the second fluid path 272 and an opening 276 in fluid communication with the second fluid path 272. The second fluid path 272 can surround the solenoid coil 286, as shown in FIG. 2. The opening 276 is aligned with the electrical lead 270 of the solenoid assembly 208. The opening 276 may be aligned with the electrical lead 270 in any suitable manner. For example, in some embodiments, the opening 276 can be circumferentially aligned with the electrical lead 270, longitudinally aligned with the electrical lead 270, and/or radially aligned with the electrical lead 270.

In use, when the solenoid coil 286 is energized and de-energized (via the electrical lead 270), the solenoid assembly 208 moves the pumping element 292 within the first pumping chamber 212 and the second pumping chamber 214, as shown by arrow GG. Movement of the pumping element 292 produces a flow within the first fluid path 274 and the second fluid path 272. For example, the pumping element 292 can draw in a first portion of fluid from the reservoir R and produce a first flow within the first fluid path 274 that supplies an engine or other device with a working fluid (e.g., fuel, coolant, lubricant). In the same motion, the pumping element 292 can also draw in a second portion of fluid from the reservoir and produce a second flow within the second fluid path 272 to cool the solenoid assembly 208. More particularly, the pumping element 292 is configured to convey the second portion of the fluid within the second fluid path 272 via the opening 276 when the solenoid assembly 208 is energized and de-energized. Moreover, because the opening 276 is aligned with the electrical lead 270, the flow into and/or out of the opening 276 can provide enhanced cooling to the area of potentially high heat generation (e.g., due to the current within the electrical lead 270).

Although the second fluid path 272 is shown as surrounding the solenoid coil 286, in other embodiments the second fluid path 272 can pass only a portion or portions of the solenoid coil 286. In other embodiments, the second fluid path 272 can be a helical path that winds around the solenoid coil 286. Additionally, the second fluid path 272 can optionally include structures to enhance turbulence in the area of the solenoid coil 286 in order to facilitate high heat transfer.

Figure 3:
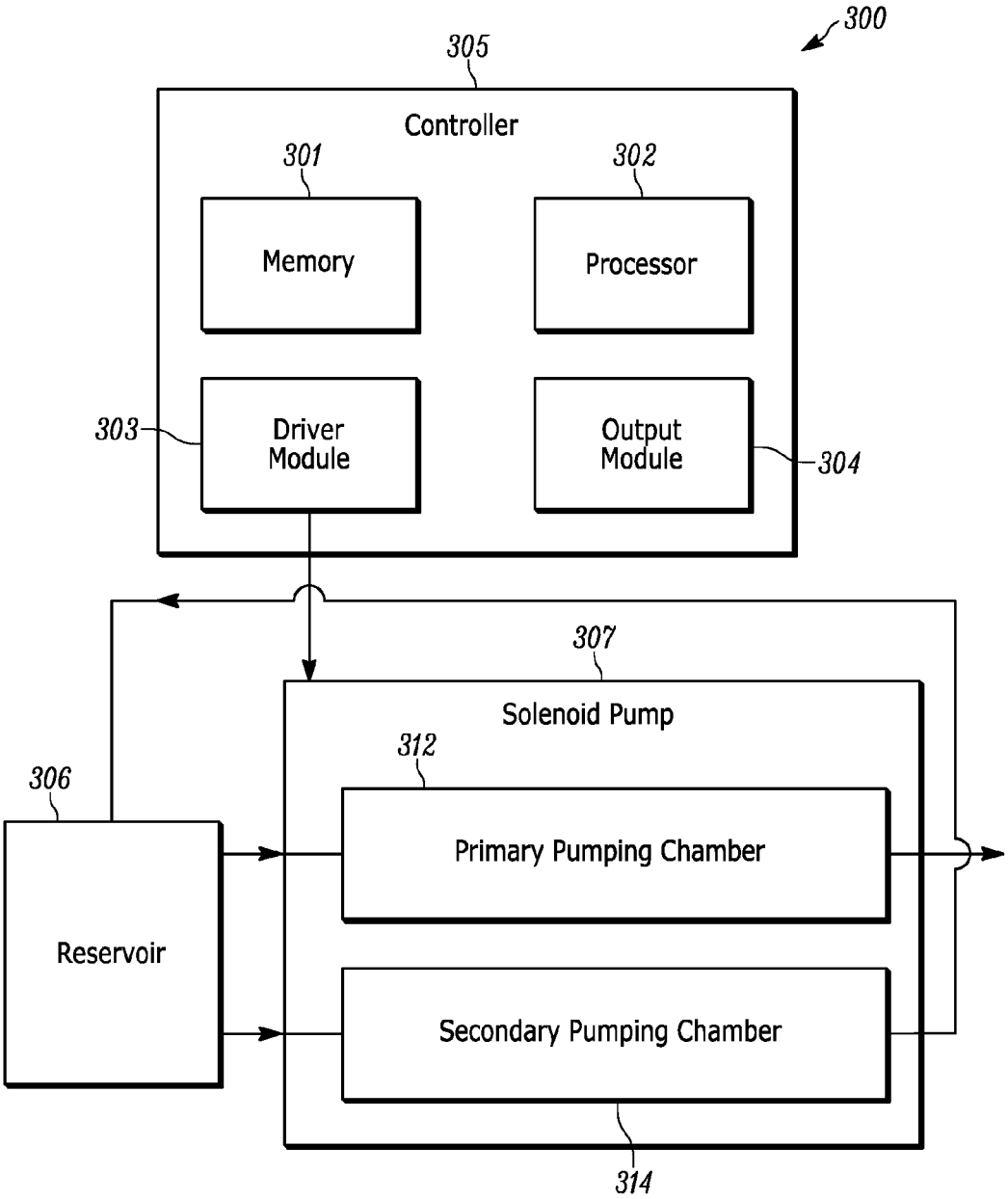
FIG. 3 is a schematic illustration of a fluid transfer system, according to an embodiment.

FIG. 3 is a schematic illustration of a fluid transfer system, according to an embodiment. The fluid transfer system 300 includes a controller 305 and a solenoid pump 307. The solenoid pump 307 (or solenoid-actuated pump) can be any suitable assembly, such as a reciprocating solenoid pump. The controller 305 can be any suitable controller, such as a vehicle control module, an engine control module, and/or the like. The controller 305 can include a memory 301, a processor 302, a driver module 303, and an output module 304.

The solenoid pump 307 defines an interior volume within which at least a portion of a first (or primary) pumping chamber 312 and a second (or secondary) pumping chamber 314 are defined. The housing is configured to be coupled to a fluid reservoir, such as, for example, an oil tank, a fuel tank or the like, such that at least a portion of the solenoid pump 307 is disposed within and/or placed in fluid communication with an interior volume of the fluid reservoir. The first pumping chamber 312 delivers fluid from the fluid reservoir to, for example, portions of a vehicle, device or engine to facilitate operation of the vehicle, device or engine. The first pumping chamber 312 includes a portion of a pump element (not shown in FIG. 3) such that movement of the pump element produces a fluid flow from an inlet port (e.g., inlet port 474 shown in FIG. 5) defined by the solenoid pump 307 to an outlet port (e.g., outlet port 476 shown in FIG. 5) defined by the solenoid pump 307. The first pumping chamber 312 is characterized by a volume that allows the solenoid pump 307 to operate at a variety of frequencies that can be set for different applications. For example, some known solenoid pumps used to pump oil or fuel can operate with a pulse width of between about 50 msec and about 500 msec and at a frequency of between about 0.1 Hz and 10 Hz.

The second pumping chamber 314 implements a forced convection cooling method, as described herein. In particular, the forced convection cooling method utilizes parasitic pumping loss to produce a flow to cool the solenoid, thus reducing a thermal-related increase in electrical resistance of the solenoid coil of the solenoid pump 307. The forced convection cooling method includes the flow of a parasitic pumped fluid into and out of a housing of the solenoid pump 307 during the operation of the solenoid pump 307 via a specific fluid path that passes adjacent and/or surrounds the solenoid coil (not shown in FIG. 3). In some embodiments, the fluid path and/or the design of the second pumping chamber 314 can be configured to increase the fluid velocity around the solenoid coil to improve the heat transfer from the solenoid coil to the parasitic or working fluid. The specific fluid path taken by the parasitic (pumped) fluid can be any suitable path, such as those described in detail herein (see, e.g., FIG. 2 and FIGS. 7A-7B). The heat transfer facilitates the operation of the solenoid pump 307 at high frequencies and helps to mitigate a potential increase in the electrical resistance caused by a hot coil.

The memory 301 can be, for example, a random access memory (RAM), a memory buffer, a hard drive, a database, an erasable programmable read-only memory (EPROM), an electrically erasable read-only memory (EEPROM), a read-only memory (ROM), registers, cache memory, flash memory and/or so forth. The memory 301 can store instructions to cause the processor 302 to execute modules, processes and/or functions associated with the fluid transfer system 300.

The processor 302 can be any processor configured to, for example, write data into and read data from the memory 301, and execute the instructions and/or methods stored within the memory 301. For example, the processor 302 can be a general purpose processor, a Field Programmable Gate Array (FPGA), an Application Specific Integrated Circuit (ASIC), a Digital Signal Processor (DSP), and/or the like. The processor 302 can run and/or execute applications, modules, processes and/or functions associated with the fluid transfer system 300. Furthermore, the processor 302 can be configured to control operation of the driver module 303, output module 304, and/or any other components of the controller 305. Specifically, the processor 302 can receive a signal including, for example, current decay information and can determine the extent of the solenoid stroke. In other configurations, the processor 302 can be, for example, a combination of ASICs that are designed to perform one or more specific functions. In yet other configurations, the processor 302 can be an analog or digital circuit, or a combination of multiple circuits.

The driver module 303 includes circuitry and/or components to produce a voltage potential capable of generating a current in the solenoid coil of the solenoid pump 307 (e.g., solenoid coil 486 shown in FIGS. 4-5) to actuate the solenoid pump 307 (or any other suitable solenoid pump, such as the solenoid-actuated pump 407 described with reference to FIGS. 4-5). For example, the driver module 303 can have a diode (e.g., a flyback diode) placed in parallel with the solenoid coil 486 to clamp a back electromotive force (emf) produced by the rapid decrease of the magnetic field. The voltage of the diode clamps the maximum voltage of the solenoid as the diode allows current to flow through until the magnetic field has decreased to a point which the voltage of the diode is not maintained.

Figure 4:
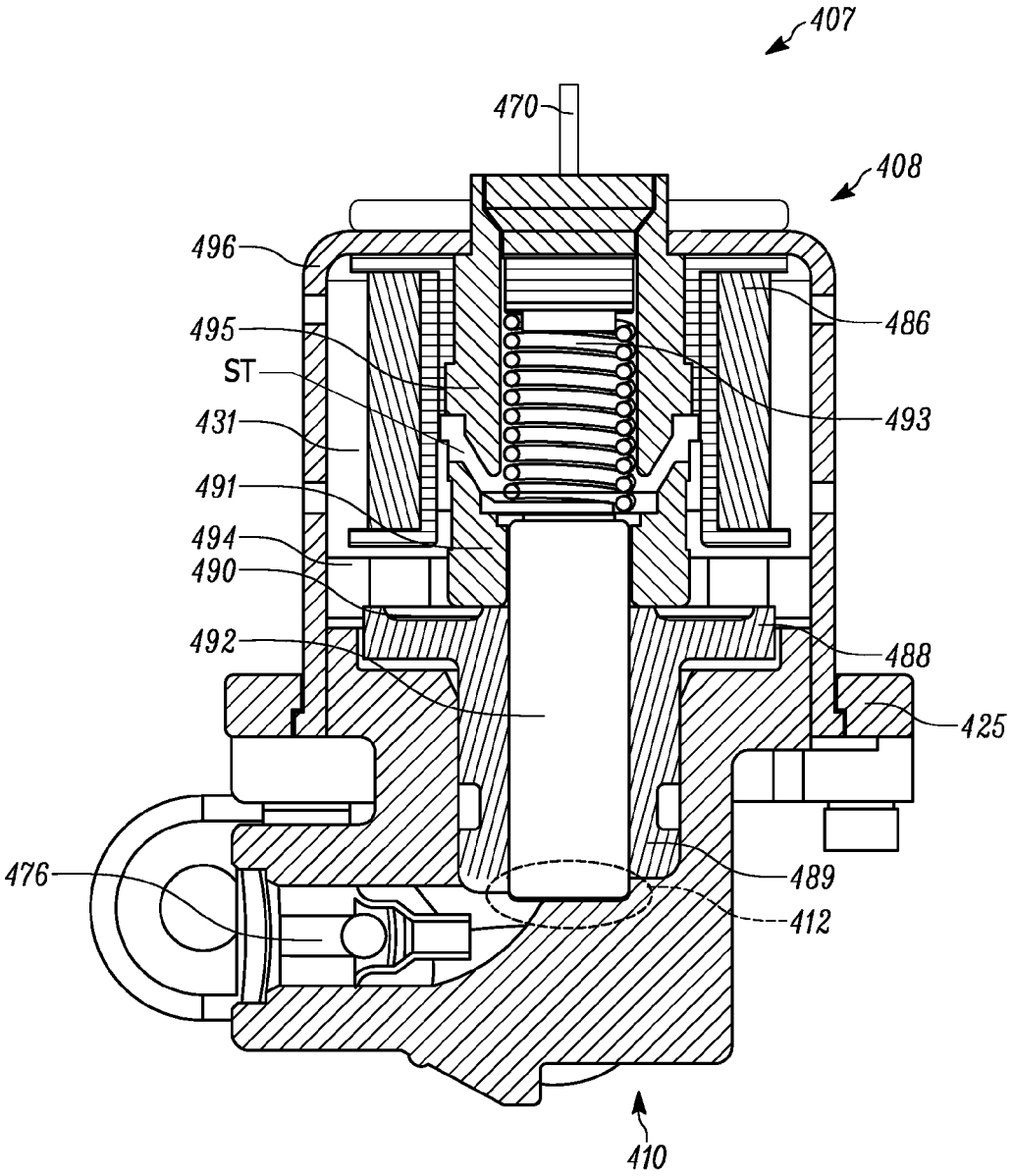
FIG. 4 is a cross-sectional view of a solenoid pump, according to an embodiment.
Figure 5:
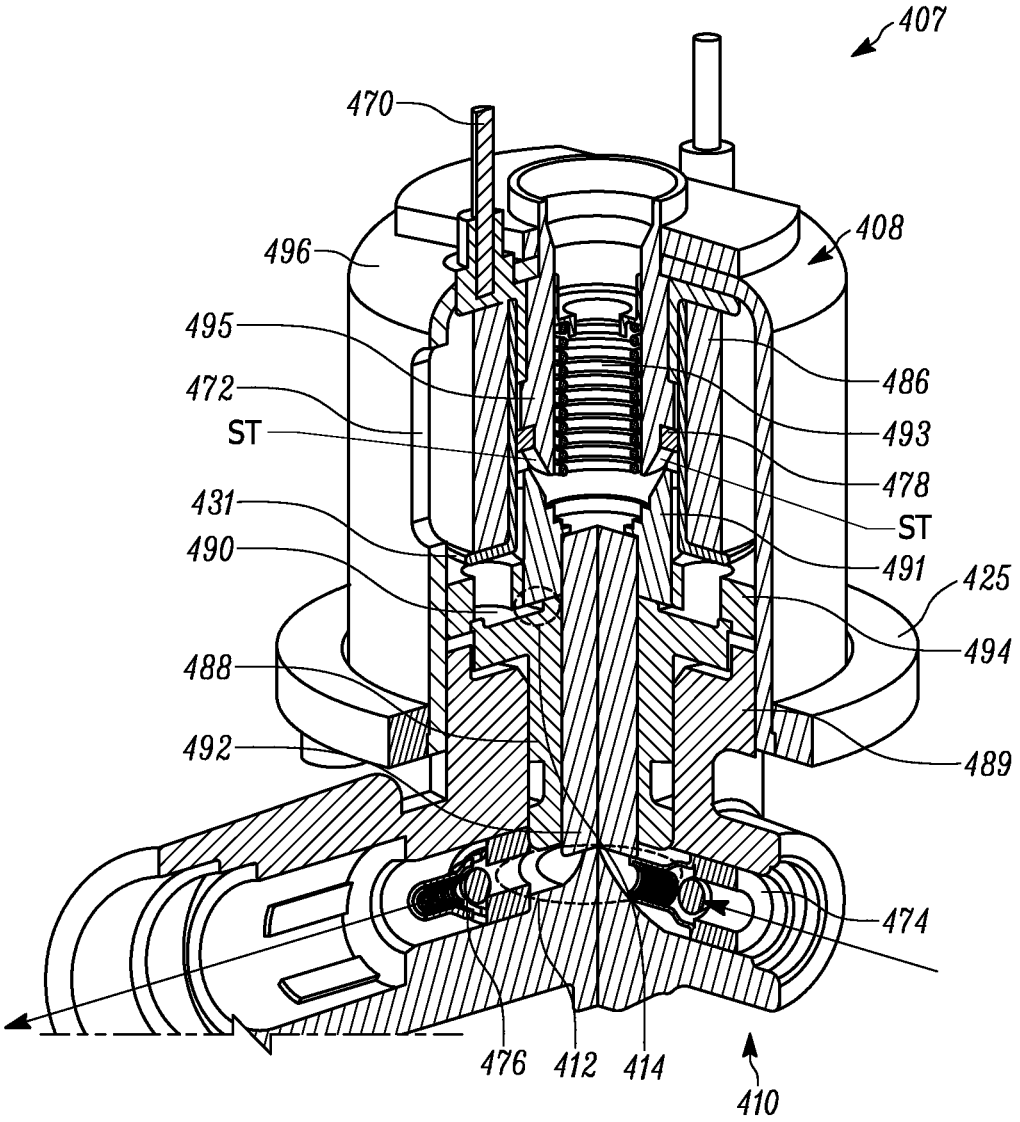
FIG. 5 is a partial cross-sectional perspective view of the solenoid pump shown in FIG. 4.

FIG. 4 is a cross-sectional view of a solenoid pump 406, according to an embodiment. FIG. 5 is a partial cross-sectional perspective view of solenoid pump 407. FIGS. 4 and 5 show an embodiment of a solenoid pump 407 that is a reciprocating solenoid pump. The solenoid pump 407 can be used in conjunction with the fluid transfer system 300 or any other suitable system. As shown in FIGS. 4 and 5, the solenoid pump 407 includes a housing 496, a solenoid assembly 408, and a pump assembly 410. The solenoid pump 407 is configured to be coupled to or disposed within a fluid reservoir (not shown in FIGS. 4 and 5) to transfer fluids from the fluid reservoir to, for example, an engine of a vehicle. Further information regarding the structure and function of the solenoid pump 407 is set forth in U.S. Provisional Patent Application, bearing Application No. 61/981,912, filed on Apr. 21, 2014, and entitled "System and Methods for Determining Solenoid Stroke," which is hereby incorporated by reference in its entirety.

The solenoid assembly 408 includes a solenoid coil 486, an armature 491, an actuator rod 492, a spring 493, a pole 495, a retaining ring 494 such as a bobbin retainer, and a lower plate 488 (also referred to as a bushing). The retaining ring 494 holds the solenoid coil 486 in place within the solenoid pump 407.

Figure 7A:
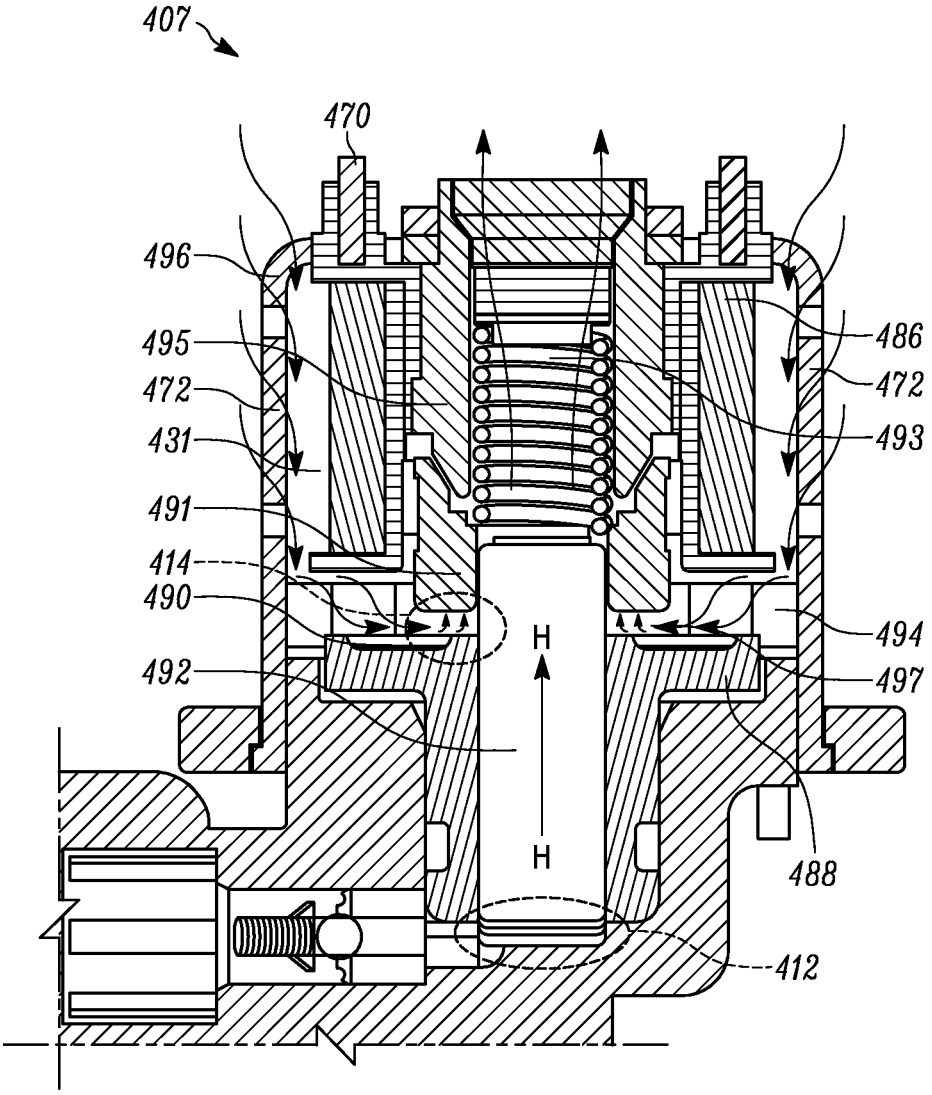
FIGS. 7A-7B are cross-sectional views of the solenoid pump shown in FIGS. 4-5 in a first configuration and a second configuration, respectively.

The lower plate 488 of the solenoid assembly 408 includes a protrusion 489. The protrusion 489 is configured to be disposed within the pump assembly 410 and receives a portion of an actuator rod 492. The actuator rod 492 and the lower plate 488 are configured such that the actuator rod 492 can freely move within and/or through the lower plate 488 when the solenoid assembly 408 is energized and de-energized. In this manner, as described herein, the movement of the actuator rod 492 can produce a desired flow within the pump assembly 410. The armature 491 is disposed within the solenoid coil 486. The solenoid assembly 408 is configured to receive an electrical signal (e.g., from any suitable controller, such as controller 305 shown in FIG. 3) through an electrical lead 470, which may include a set of electrical input wires or connectors. The signal actuates the solenoid assembly 408 (or components therein) to move in a reciprocating fashion. As described in more detail herein, the solenoid assembly 408 defines a second pumping chamber 414 (also referred to as a "parasitic" or "secondary" pumping chamber). In particular, as shown in FIG. 7A, a portion of the lower plate 488 (also referred to as a bushing) and the armature 491 collectively define the second pumping chamber 414. Movement of the armature 491 changes the volume of the second pumping chamber 414 (see FIGS. 7A and 7B) to produce a fluid flow (or "secondary flow"), as described herein. Moreover, the lower plate 488 also defines a cavity or volume 490. The secondary flow can enter and exit the secondary pumping chamber via the cavity 490 and a series of holes in a bobbin retainer 494 (see FIGS. 7A and 7B). The cavity 490 can be an annular groove in the upper surface of the plate 488, a series of openings, or the like. Although the bobbin retainer 494 is shown as having a through hole, the surface of the bobbin retainer 494 could include grooves, recesses, or other portions that define the second flow path. Additionally, the housing 496 could include spiral grooves or other recesses in order to improve flow to the second fluid path.

Figure 6A:
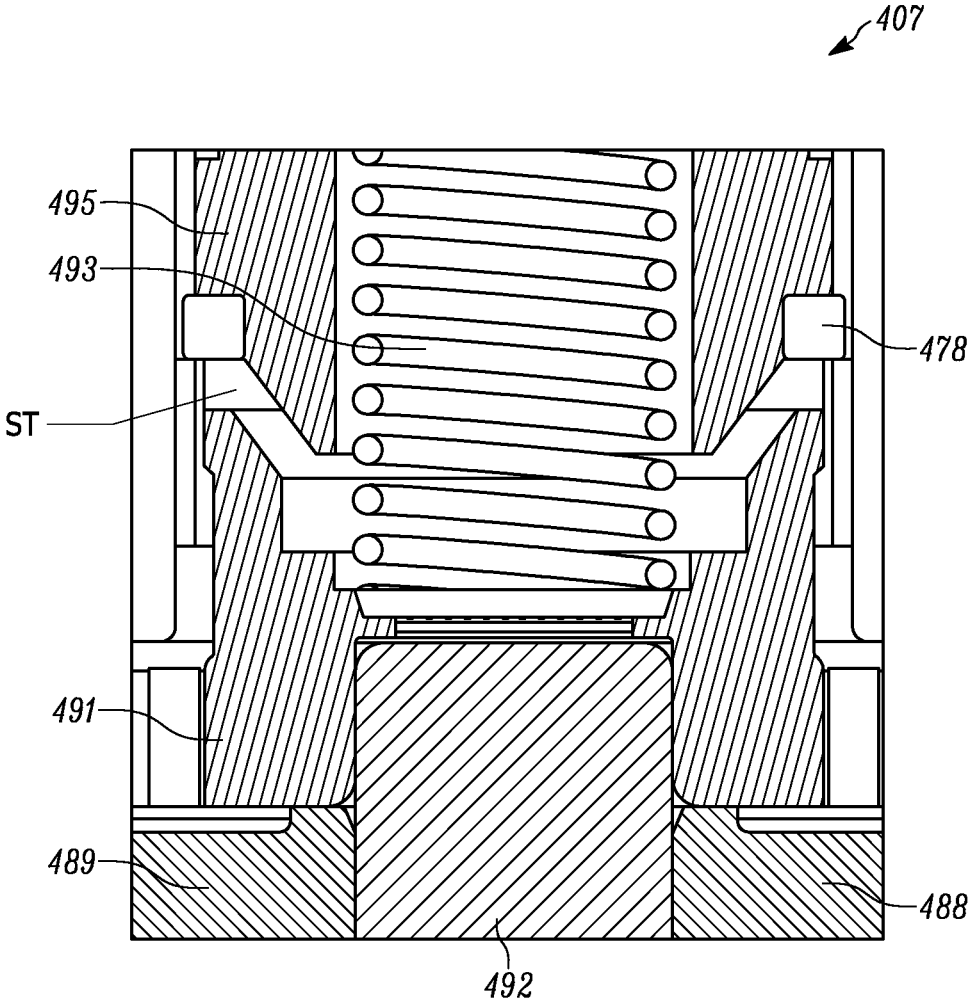
FIGS. 6A-6B are enlarged cross-sectional views of the solenoid pump shown in FIG. 4 in an energized configuration and a de-energized configuration, respectively.
Figure 6B:
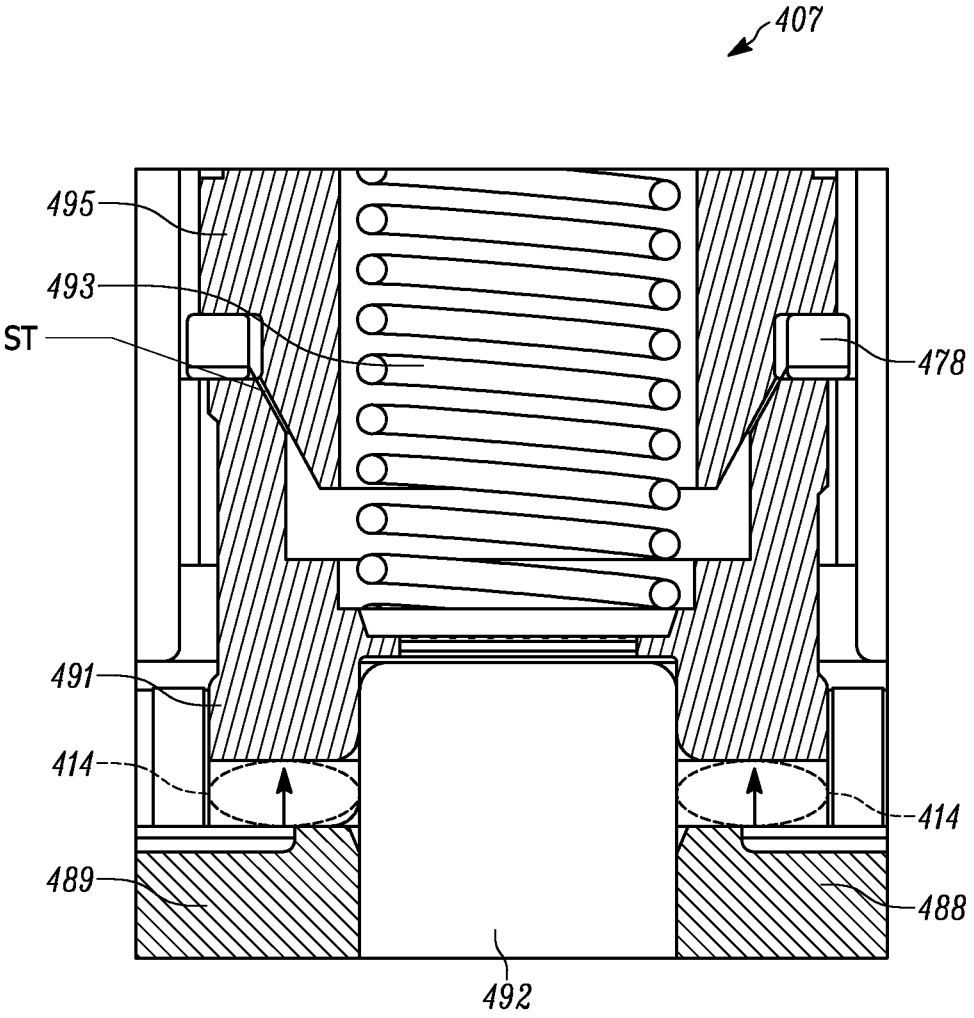
Figure 7B:
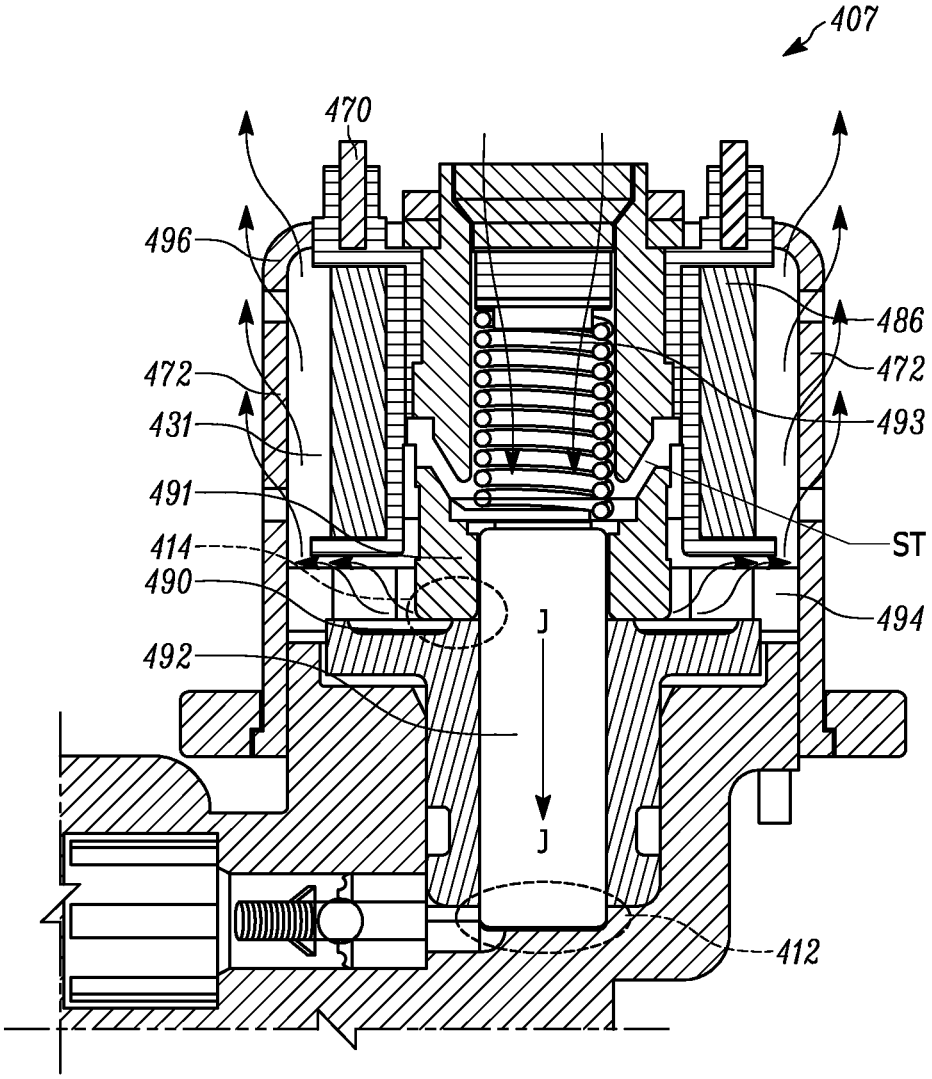

FIGS. 6A and 6B are enlarged cross-sectional views of the solenoid pump 407 in an energized configuration and a de-energized configuration, respectively. Referring to FIGS. 4-7, the solenoid pump 407 can be actuated from the de-energized configuration (i.e., when the solenoid assembly 408 is not energized as seen in FIGS. 6A and 7B) to the energized configuration (when the solenoid assembly 408 is energized as seen in FIGS. 6B and 7A). During normal operation, the gap ST (also referred to as the "stroke") between the armature 491 and the pole 495 is fully open at the de-energized configuration (e.g., FIG. 5 and FIG. 6A). The gap ST between the armature 491 and the pole 495 is fully closed at the second configuration (e.g., FIG. 6B). When the armature 491 moves from a first end-stop (occurring when the solenoid assembly 408 is in a de-energized configuration) to a second end-stop (occurring when the solenoid assembly 408 is fully energized or in an energized configuration), the armature 491 can be considered to travel a full stroke (i.e., the distance of the gap ST). The first end-stop of the armature 491 is defined by the contact point between the armature 491 and the lower plate 488, as shown in FIGS. 4 and 6A. The second end-stop of the armature 491 is defined by the contact point between the armature 491 and the pole 495, as shown in FIGS. 6B and 7A. In some instances, the pole 495 can include shock absorbers 478 to prevent the armature 491 from directly impacting the pole 495. As the solenoid pump 407 is actuated from the first configuration to the second configuration, a fluid flow is produced from the inlet port 474 (defined by the pump assembly 410) to the pumping chamber 412 (defined by the pump assembly 410), as described in more detail below.

The pump assembly 410 is operatively coupled to the solenoid assembly 408, and defines a first (or primary) pumping chamber 412, an inlet port 474 and an outlet port 476. The actuator rod 492 is slidably disposed within the lower plate 488 of the solenoid assembly 408 such that a portion of the actuator rod 492 reciprocates within the pumping chamber 412 when the solenoid is actuated. In particular, when the solenoid assembly 408 is energized, the actuator rod 492 moves as shown by the arrow HH in FIG. 7A and compresses the spring 493. This decreases the pressure within the first pumping chamber 412 (by increasing the volume of the first pumping chamber 412) and causes fluid to flow from the fluid reservoir via the inlet port 474 into the first pumping chamber 412 (as shown in FIG. 5). Thus, a portion of the fluid within the interior volume of the fluid reservoir is delivered to a volume within the first pumping chamber 412. Subsequently, when the electrical signal (i.e., electrical current) is removed from the solenoid assembly 408, the spring 493 expands to move the pump element (i.e., the assembly of the armature 491 and the actuator rod 492) back to the first position as shown by the arrow JJ in FIG. 7B (i.e., the output stroke). The movement of the pump element towards the first position moves the actuator rod 492 within the first pumping chamber 412, thus increasing the pressure applied to the fluid within the first pumping chamber 412 (by reducing the volume of the first pumping chamber 412). This causes the fluid to flow out from the first pumping chamber 412 through the outlet port 476 (as shown in FIG. 5). Hence, a portion of the fluid within the interior volume of the first pumping chamber 412 is delivered to a volume outside the solenoid pump 407. With the solenoid pump 407 back in the first position, the electrical source can again supply a flow of electrical current to the solenoid assembly 408 such that the pumping process can be repeated.

While the first pumping chamber 412 is shown to have an inlet port and an outlet port, the first pumping chamber 412 may include any port arrangement, such as including only one port that is used for both fluid entry and expulsion, or including multiple ports which are each designated as being for fluid entry, expulsion, or both. Additionally, the first pumping chamber 412 may optionally include any valve arrangement to control the flow of fluid.

Although shown in FIGS. 4-7 as receiving a single pump element, in other embodiments, the pump assembly 410 can define any number of cavities (or pumping chambers) configured to receive any number of pump elements. In other embodiments, the pump element can be a portion of a vane pump, a progressive cavity pump, a gear pump, a gyrator pump, a pneumatic pump, and/or the like. Although shown as producing a fluid flow out of the reservoir (as shown by the arrows in FIG. 5), in other embodiments, movement of the pump element relative to and/or within the housing 496 can produce a flow in any suitable direction (e.g., into or out of the reservoir). Moreover, although the pump element is shown as moving linearly within the cavity 431 to produce the flow, in other embodiments the pump element can move in any suitable manner within the cavity 431 (e.g., rotationally) to produce the flow.

The housing 496 defines a cavity 431 within which at least a portion of the solenoid assembly 408 and at least a portion of the pump assembly 410 are disposed. The housing 496 may surround or substantially surround the solenoid coil 486. The housing 496 can be any suitable size, shape, or configuration and can be formed using any suitable material or method. For example, in some embodiments, the housing 496 can be formed from, molded plastic, cast metal, or machined material (e.g., machined billet material such as aluminum). In some embodiments, at least a portion of the housing 496 defines a portion of a magnetic return path, and thus is constructed from a ferrous material. The housing 496 is configured to be coupled to a reservoir, such as for example, an oil tank, fuel tank or the like, such that at least a first portion of the housing 496 is disposed within an interior volume of the reservoir, and at least a second portion of the housing 496 is disposed outside the interior volume of the reservoir. Alternatively, the entire housing may be disposed within a reservoir containing the fluid moved into the second pumping chamber. The housing may define at least one inlet-outlet port of the second fluid path, the inlet-outlet port being aligned with one of the electrical leads.

The housing 496 can also include a seal portion 425 configured to fluidically isolate the assembly within the reservoir. In some embodiments, the seal portion 425 can include at least one seal member, such as, for example, an O-ring. In other embodiments, the seal portion 425 can include a sealing membrane, a threaded fitting, a grommet, and/or the like. Furthermore, the seal portion 425 can include a coupling member and/or retention member (e.g., a snap ring, clip, threaded nut, and/or the like (not shown)). For example, in some embodiments, the seal portion 425 can include a snap ring configured to maintain at least the seal portion 425 in contact with a portion of the reservoir. Thus the seal portion 425 (e.g., at least a seal member included in the seal portion 425) can engage a wall of the reservoir such that the inner volume of the reservoir is fluidically isolated from the volume outside the reservoir.

As shown in FIGS. 7A-7B, the housing 496 defines at least one parasitic fluid opening 472 through which the fluid in the fluid reservoir can enter and/or exit the solenoid pump 407 during actuation of the pump element from the de-energized configuration to the energized configuration and back. In this manner, as described herein, a portion of the fluid (also referred to as the "secondary flow") can be reciprocally moved into and out of the second pumping chamber 414 via the opening(s) 472, the cavity 431, the holes defined by the bobbin retainer 494 and the cavity 490 defined by the lower plate 488. The at least one opening 472 can be circumferentially aligned with and parallel to the electrical lead 470, as shown in FIGS. 7A and 7B, such that the cooling flow is concentrated near the areas of highest expected heat generation (due to the current supply via the wires 470). Although shown as being slots, in other embodiments, the at least one opening 472 can be any suitable size and/or shape. Although the opening 476 is shown as being circumferentially aligned with the electrical lead 470, the opening 476 may be aligned with the electrical lead 470 in any suitable manner. For example, in some embodiments, the opening 476 can be longitudinally aligned with the electrical lead 470 and/or radially aligned with the electrical lead 470.

Further to the description above, during normal operation, the solenoid-actuated pump 407 is actuated from the de-energized configuration (FIGS. 6A, 7B) to the energized configuration (FIGS. 6B, 7A) to achieve a full stroke and deliver a flow into the first pumping chamber 412. In addition, the solenoid also produces a secondary flow to cool the coil, thus limiting the increase in coil resistance due to heating during operation of the solenoid pump 407. More specifically, as shown by the series of arrows in FIGS. 7A-7B, the secondary flow is conveyed through the at least one fluid opening 472 into and out of the second pumping chamber 414 via the cavity 431 and the flow path defined by the cavity 490. Thus, when the solenoid pump 407 is actuated from the de-energized configuration to the energized configuration and back, a reciprocal flow into and out of the cavity 430 is produced.

When the solenoid coil 486 is energized, the armature 491 and the armature rod 492 are pulled toward the pole 495 in the direction of the arrow HH shown in FIG. 7A. The bobbin retainer 494 has an inner surface 497 that can define at least a portion of the second pumping chamber 414 and/or at least a portion of the second fluid path. Because the armature 491 has an outer diameter that results in a tight clearance fit with the inner surface 497 of the bobbin retainer 494 (e.g., a clearance of between about 0.05 mm to 0.35 mm per side), the bottom surface of the armature 491, the outer surface of the armature rod 492, and the inner surface 497 of the bobbin retainer 494 act as an effective pumping chamber (i.e., to define the second pumping chamber 414). More particularly, as the armature 491 and armature rod 492 move during the energized stroke, fluid is drawn from the fluid reservoir via the fluid opening 472 and through the cavity in the lower plate 488 into the second pumping chamber 414 (as shown by the series of arrows in FIG. 7A). When the solenoid 408 is de-energized, the armature 491 and armature rod 492 move in the direction of the arrow JJ so that the surface of the armature moves the parasitic fluid out of the solenoid pump 407 via the second fluid path (as shown by the series of arrows in FIG. 7B).

The cavity 431 is defined such that the secondary flow passes around the solenoid coil 486. Moreover, the internal clearances within the cavity 431 are such that the fluid velocity around the solenoid coil 486 is increased, which improves the heat transfer from the solenoid coil 486 to the parasitic or secondary flow. In particular, increasing the velocity of the secondary flow around the coil 486 can produce a turbulent flow and otherwise break and/or disrupt the boundary layer around the coil 486 to improve the convection heat transfer between the coil 486 and the secondary flow. The enhanced heat transfer allows for the efficient operation of the solenoid pump 407 by mitigating the increase in electrical resistance caused by a hot coil 486 during operation of the solenoid pump 407, particularly at high frequencies.

It is to be noted that the fluid pathway for the intake and exit of the parasitic fluid into the cavity 431 is such that the maximum heat transfer can take place in the regions of the solenoid coil 486 in the immediate vicinity of the electrical leads 470. For example, the openings 472 can be positioned in circumferential alignment with the leads 470 to facilitate high flow in this region. This arrangement enhances the heat transfer efficiency because such regions of the solenoid coil 486 experience the maximum amount of thermal-related increase in electrical resistance.

Figure 8:
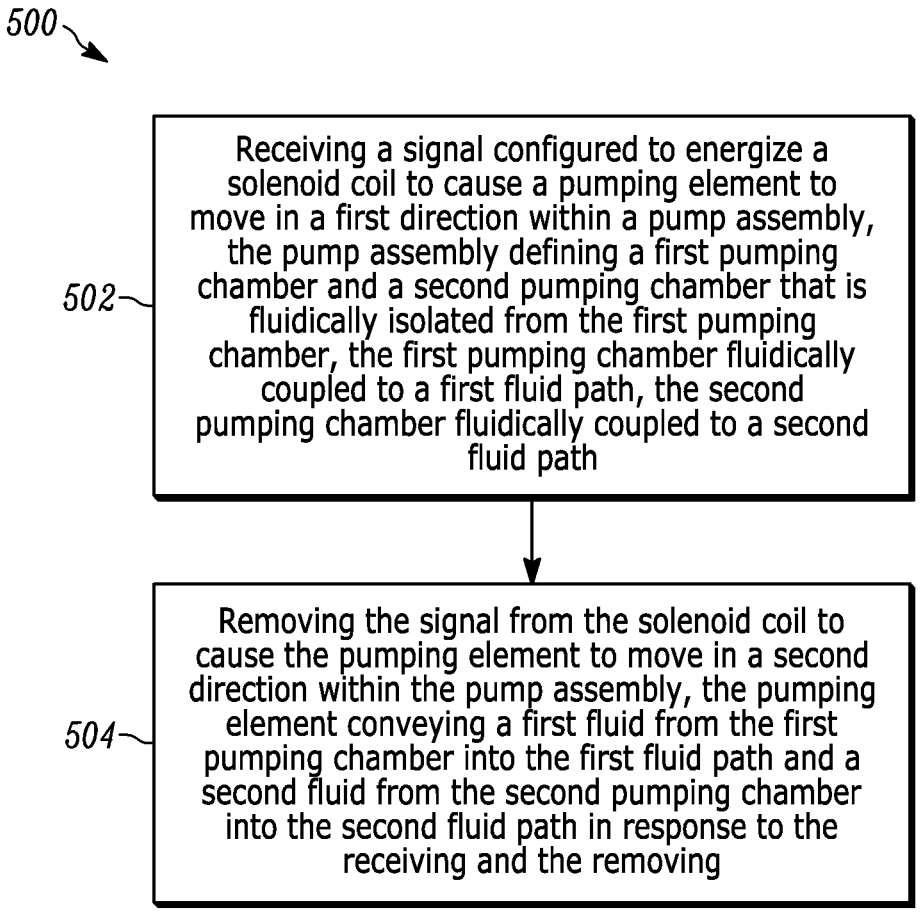
FIG. 8 is a flow chart illustrating a method for energizing and de-energizing a solenoid coil to move a pumping element during operation of a fluid transfer assembly, according to an embodiment.

FIG. 8 is a flow chart illustrating a method 500 for energizing and de-energizing a solenoid coil to move a pumping element during operation of a fluid transfer assembly, according to an embodiment. The method includes receiving a signal configured to energize a solenoid coil to cause a pumping element to move in a first direction within a pump assembly, at 502. The pump assembly defines a first pumping chamber and a second pumping chamber that is fluidically isolated from the first pumping chamber. The first pumping chamber is fluidically coupled to a first fluid path and the second pumping chamber is fluidically coupled to a second fluid path. At 504, the signal is removed from the solenoid coil to cause the pumping element to move in a second direction within the pump assembly. In response to the receiving and removing of the signal, a first fluid is conveyed from the first pumping chamber into the first fluid path and a second fluid is conveyed from the second pumping chamber into the second fluid path.

The solenoid coil and the pump assembly can be any of the pump assemblies and solenoid assemblies shown and described herein. For example, in some embodiments, the solenoid coil can be disposed within a solenoid housing, and the solenoid housing can define a portion of the second fluid path. In some embodiments, the pump assembly can define an inlet port through which the first fluid moves into the first pumping chamber and an outlet port through which the first fluid moves out of the first pumping chamber, wherein the inlet port is separate from the outlet port. The pump assembly can also define a port through which the second fluid moves into and out of the second pumping chamber. The second chamber can be defined at least partially by a retaining ring configured to retain the solenoid coil within a solenoid assembly. In some embodiments, the method step 502 can optionally include receiving the signal via an electrical lead coupled to the solenoid coil. The second fluid can be conveyed from the second fluid path to an area outside of the solenoid assembly via an opening, where the opening is aligned with the electrical lead.

Figure 9:
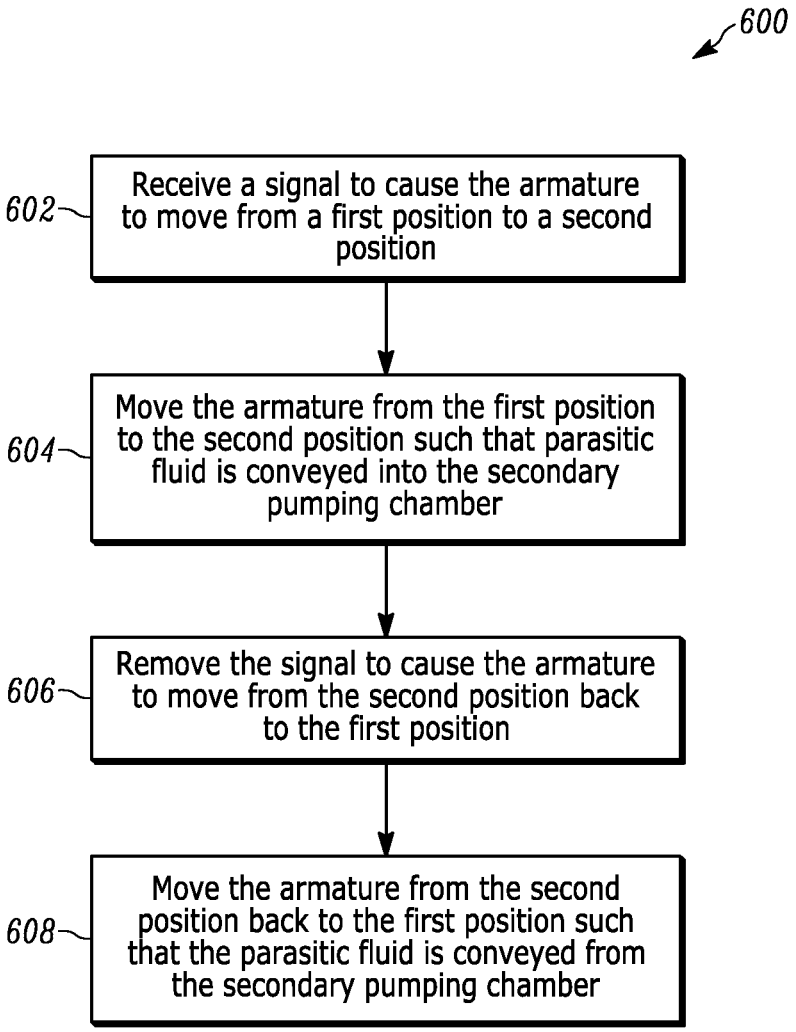
FIG. 9 is a flow chart illustrating a method for cooling a solenoid assembly during operation of a fluid transfer assembly, according to an embodiment.

FIG. 9 is a flow chart illustrating a method for producing a secondary flow during operation of a fluid transfer assembly, according to an embodiment. The method 600 includes receiving a signal to cause an armature to move from a first position to a second position, at 602. As described above, the signal can be, for example, an electrical current or an electrical signal sent from a controller such as, for example, the controller 305 shown in FIG. 3 to cause the armature of, for example, a solenoid pump to move from a first position to a second position. As described above, the controller can be any suitable controller, such as a vehicle control module, an engine control module or the like.

At 604, the armature is moved from the first position to the second position such that parasitic fluid is conveyed into the second pumping chamber. As described above, the first position of the armature can be associated with a de-energized configuration of, for example, a solenoid pump. The second position of the armature can be associated with an energized configuration of, for example, a solenoid pump. As described above, in some instances, movement of the armature from the first position to the second position involves the armature travelling a specified distance to close or substantially close a working air gap (e.g., air gap ST shown in FIGS. 4-7), for example, between the armature and a pole. Such movement of the armature from the first position to the second position is defined as the "energized stroke" of the armature.

As described above, movement of the armature and armature rod can draw fluid from a fluid reservoir via, for example, parasitic fluid opening(s) on the housing of the solenoid pump, into the second pumping chamber. As described above, the intake of fluid can be through a fluid pathway that passes around the solenoid coil. This in turn increases the fluid velocity around the solenoid coil and improves the heat transfer from the solenoid coil to the parasitic or working fluid by increasing the velocity of the parasitic fluid which breaks the boundary layer around the solenoid coil. The enhanced heat transfer allows the operation of the solenoid pump and helps to mitigate the higher electrical resistance caused by a hot coil during operation of the solenoid pump, particularly at high frequencies.

At 606, the signal is removed to cause the armature to move from the second position back to the first position.

At 608, the armature is moved from the second position back to the first position such that the parasitic fluid is conveyed from the second pumping chamber. As described above, the second position of the armature can be associated with the energized configuration of, for example, a solenoid pump, and the first position of the armature can be associated with a de-energized configuration of, for example, a solenoid pump. Such movement of the armature from the second position to the first position is defined as the "de-energized stroke" of the armature.

The movement of the armature back to the first position causes the pressure applied to the parasitic fluid in the secondary pumping chamber to increase, resulting in the parasitic fluid being conveyed from the second pumping chamber. The parasitic fluid may then pass over a coil, resulting in heat transfer from the coil to the parasitic fluid. The parasitic fluid may be conveyed from the second pumping chamber through a parasitic fluid opening in the housing. This can lead to an increase in fluid velocity. The increase in fluid velocity of the parasitic fluid may break the boundary layer and increase the heat transfer from the coil to the parasitic fluid. As described above, the heat-transfer process described herein is repeated as many times as the solenoid pump moves from the energized configuration to the de-energized configuration, thus allowing for operation of the solenoid pump at high frequencies in a manner that mitigates the higher electrical resistance caused by a hot coil.

The fluid transfer systems of the embodiments described herein can be any suitable system for transferring and/or pumping fluids, and can be used in conjunction with any suitable equipment. In some embodiments, the fluid transfer system can be any suitable system for transferring and/or pumping fluids in conjunction with vehicles or the like (e.g., a recreational vehicle, all-terrain vehicle (ATV), snowmobile, dirt bike, watercraft, on-highway vehicles, off-highway construction vehicles, or the like). In some embodiments, the fluid transfer system can be used as an oil pump to transfer oil to an engine included in the vehicle. The fluid transfer system can have any suitable shape, size, or configuration. For example, the fluid transfer system can have a substantially circular cross-section, a square cross-section, a rectangular cross-section, an oblong cross-section, or any other suitable shape. Furthermore, the fluid transfer system can include components formed from any suitable material or any suitable combination of materials. For example, in some embodiments, portions of the fluid transfer system can be formed from molded plastic, rubber, cast metal, or machined material (e.g., machined billet material, such as aluminum).

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but can be implemented using a variety of alternative architectures and configurations. Additionally, although the invention is described above in terms of various embodiments and implementations, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described embodiments.

Some embodiments described herein, such as for example, the production of a signal to actuate any of the solenoid pumps described herein, relate to a computer storage product with a non-transitory computer-readable medium (also can be referred to as a non-transitory processor-readable medium) having instructions or computer code thereon for performing various computer-implemented operations. The computer-readable medium (or processor-readable medium) is non-transitory in the sense that it does not include transitory propagating signals per se (e.g., a propagating electromagnetic wave carrying information on a transmission medium such as space or a cable). The media and computer code (also can be referred to as code) may be those designed and constructed for the specific purpose or purposes. Examples of non-transitory computer-readable media include, but are not limited to: magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), Read-Only Memory (ROM) and Random-Access Memory (RAM) devices.

Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using imperative programming languages (e.g., C, Fortran, etc.), functional programming languages (Haskell, Erlang, etc.), logical programming languages (e.g., Prolog), object-oriented programming languages (e.g., Java, C++, etc.) or other suitable programming languages and/or development tools. Additional examples of computer code include, but are not limited to, control signals, encrypted code, and compressed code.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. Although various modules in the different devices are shown to be located in the processors of the device, they can also be located/stored in the memory of the device (e.g., software modules) and can be accessed and executed by the processors.

What is claimed is:

1. An apparatus, comprising:

a pump assembly defining a first pumping chamber and a second pumping chamber that is fluidically isolated from the first pumping chamber, the first pumping chamber fluidically coupled to a first fluid path, the second pumping chamber fluidically coupled to a second fluid path;

a pumping element configured to move within the pump assembly between a first configuration and a second configuration, the pumping element configured to move a first fluid into the first pumping chamber and to move a second fluid into the second pumping chamber when the pumping element moves from the first configuration to the second configuration, the pumping element configured to expel the first fluid from the first pumping chamber and the second fluid from the second pumping chamber when the pumping element moves from the second configuration to the first configuration, and a solenoid coil coupled to the pump assembly, the solenoid coil configured to move the pumping element from the first configuration to the second configuration when the solenoid coil is energized, the pumping element configured to move from the second configuration to the first configuration when the solenoid coil is de-energized, the second fluid path surrounding the solenoid coil.

2. The apparatus of claim 1, wherein the solenoid assembly defines at least part of the second fluid path.

3. The apparatus of claim 1, wherein:

the pump assembly defines an inlet port through which the first fluid moves into the first pumping chamber and an outlet port through which the first fluid moves out of the first pumping chamber, the inlet port separate from the outlet port, the pump assembly defines a port through which the second fluid moves into and out of the second pumping chamber.

4. The apparatus of claim 1, wherein the solenoid coil includes an electrical lead, the apparatus further comprising:

a housing surrounding the solenoid coil and configured to be disposed within a reservoir containing the second fluid, the housing defining at least one inlet-outlet port of the second fluid path, the inlet-outlet port being aligned with one of the electrical leads.

5. An apparatus, comprising:

a pump assembly defining a first pumping chamber and a second pumping chamber that is fluidically isolated from the first pumping chamber, the first pumping chamber fluidically coupled to a first fluid path, the second pumping chamber fluidically coupled to a second fluid path;

a pumping element configured to move within the pump assembly between a first configuration and a second configuration, the pumping element configured to move a first fluid into the first pumping chamber and to move a second fluid into the second pumping chamber when the pumping element moves from the first configuration to the second configuration, the pumping element configured to expel the first fluid from the first pumping chamber and the second fluid from the second pumping chamber when the pumping element moves from the second configuration to the first configuration, wherein the pumping element includes an armature and an actuator rod, the armature operably coupled to a solenoid assembly such that the pumping element moves from the first configuration to the second configuration when the solenoid is energized, a surface of the armature configured to move the second fluid from the second pumping chamber and through the second fluid path, a surface of the rod configured to move the first fluid from the first pumping chamber and through the first fluid path.

6. An apparatus, comprising:

a pump assembly defining a first pumping chamber and a second pumping chamber that is fluidically isolated from the first pumping chamber, the first pumping chamber fluidically coupled to a first fluid path, the second pumping chamber fluidically coupled to a second fluid path;

a pumping element configured to move within the pump assembly between a first configuration and a second configuration, the pumping element configured to move a first fluid into the first pumping chamber and to move a second fluid into the second pumping chamber when the pumping element moves from the first configuration to the second configuration, the pumping element configured to expel the first fluid from the first pumping chamber and the second fluid from the second pumping chamber when the pumping element moves from the second configuration to the first configuration, a solenoid assembly coupled to the pump assembly, the solenoid assembly configured to move the pumping element from the first configuration to the second configuration when the solenoid assembly is energized, the pumping element configured to move from the second configuration to the first configuration when the solenoid assembly is de-energized; and a retaining ring configured to retain a coil within the solenoid assembly, the retaining ring defining at least a portion of the second pumping chamber.

7. The apparatus of claim 6, wherein the retainer ring includes at least one hole, at least one groove or at least one recess forming part of the second fluid path.

8. An apparatus, comprising:

a pump assembly including a pumping element and defining a first pumping chamber and a second pumping chamber that is fluidically isolated from the first pumping chamber, the first pumping chamber fluidically coupled to a first fluid path, the second pumping chamber fluidically coupled to a second fluid path;

a solenoid assembly including a solenoid coil and at least one electrical lead, the solenoid assembly configured to move the pumping element within the first pumping chamber and the second pumping chamber when the solenoid coil is energized; and a housing configured to contain the solenoid assembly, the housing configured to be disposed within a reservoir containing a fluid, the housing defining at least a portion of the second fluid path, the housing defining an opening in fluid communication with the second fluid path, the opening aligned with the electrical lead of the solenoid assembly, the pumping element configured to convey a portion of the fluid within the second fluid path via the opening when the solenoid assembly is energized and de-energized.

9. The apparatus of claim 8, wherein:

the opening is a second opening;

the portion of the fluid is a second portion of the fluid; and the pumping element configured to convey a first portion of the fluid from the first pumping chamber into the first fluid path via a first opening when the solenoid assembly is energized and de-energized, the first fluid path being separate from the second fluid path.

10. The apparatus of claim 8, wherein the opening and the second fluid path are configured such that the portion of the fluid moves into and out of the second pumping chamber via the opening when the solenoid assembly is energized and de-energized.

11. The apparatus of claim 8, wherein:

the portion of the fluid is a second portion of the fluid; and the pumping element includes an armature and a piston, the piston configured to move a first portion of the fluid through the first fluid path, a surface of the armature configured to move the first fluid through the first fluid path.

12. The apparatus of claim 8, wherein the housing is configured such that the second fluid path substantially surrounds the solenoid coil.

13. The apparatus of claim 8, the apparatus further comprising a retaining ring configured to retain the solenoid coil within the solenoid assembly, the retaining ring defining at least a portion of the second pumping chamber.

14. The apparatus of claim 13, wherein the retainer ring includes one of at least one hole, at least one groove and at least one recess forming part of the second fluid path.

15. The apparatus of claim 8, the apparatus further comprising a retaining ring configured to retain the solenoid coil within the solenoid assembly, the retaining ring defining at least a portion of the second fluid path.

16. A method, comprising:

receiving, at a first time, a signal configured to energize a solenoid coil to cause a pumping element to move in a first direction within a pump assembly, the pump assembly defining a first pumping chamber and a second pumping chamber that is fluidically isolated from the first pumping chamber, the first pumping chamber fluidically coupled to a first fluid path, the second pumping chamber fluidically coupled to a second fluid path; and removing, at a second time after the first time, the signal from the solenoid coil to cause the pumping element to move in a second direction within the pump assembly, wherein the pumping element conveying a first fluid from the first pumping chamber into the first fluid path and a second fluid from the second pumping chamber into the second fluid path in response to the receiving and the removing, and wherein the second pumping chamber is defined at least partially by a retaining ring configured to retain the solenoid coil within a solenoid assembly.

17. The method of claim 16, wherein the solenoid coil is disposed within a solenoid housing, the solenoid housing defining a portion of the second fluid path.

18. The method of claim 16, wherein:

the pump assembly defines an inlet port through which the first fluid moves into the first pumping chamber and an outlet port through which the first fluid moves out of the first pumping chamber, the inlet port separate from the outlet port, the pump assembly defines a port through which the second fluid moves into and out of the second pumping chamber.

19. The method of claim 16, wherein:

the pump assembly defines a port through which the second fluid moves into and out of the second pumping chamber.

20. The method of claim 16, wherein:

the receiving the signal includes receiving the signal via an electrical lead coupled to the solenoid coil; and the second fluid is conveyed from the second fluid path to an area outside of the solenoid assembly via an opening, the opening aligned with the electrical lead.

* * * * *